US008245462B2

(12) United States Patent
Miethe et al.

(10) Patent No.: US 8,245,462 B2
(45) Date of Patent: Aug. 21, 2012

(54) SNAP CLIP RETAINER FOR WINDOW FIXED SASH

(75) Inventors: Ralf Miethe, Puyallup, WA (US); Kevin D. Vilhauer, Tacoma, WA (US); John Tremble, Redmond, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 200 days.

(21) Appl. No.: 12/156,079

(22) Filed: May 29, 2008

(65) Prior Publication Data

US 2009/0293387 A1 Dec. 3, 2009

(51) Int. Cl.
*E06B 3/988* (2006.01)

(52) U.S. Cl. ..... 52/204.7; 52/204.62

(58) Field of Classification Search ..... 52/204.62, 52/204.51, 204.55, 214, 204.7, 204.5
See application file for complete search history.

(56) References Cited

U.S. PATENT DOCUMENTS

| | | | | | |
|---|---|---|---|---|---|
| 2,499,637 | A | | 3/1950 | Flora | |
| 2,840,202 | A | | 6/1958 | Hehr | |
| 2,840,203 | A | | 6/1958 | Hehr | |
| 3,148,753 | A | * | 9/1964 | Hodgen et al. | 52/204.51 |
| 3,151,715 | A | * | 10/1964 | Hagerty et al. | 52/127.6 |
| 3,196,497 | A | * | 7/1965 | Malmrose et al. | 49/261 |
| 3,925,953 | A | * | 12/1975 | LaBorde | 52/745.19 |
| 4,028,849 | A | * | 6/1977 | Anderson | 49/181 |
| 4,068,506 | A | | 1/1978 | Phelps | |
| 4,457,110 | A | | 7/1984 | Beirnes | |
| 5,069,013 | A | * | 12/1991 | Pliml, Jr. | 52/214 |
| 5,083,409 | A | * | 1/1992 | Pliml, Jr. | 52/656.9 |
| 5,555,684 | A | * | 9/1996 | Galowitz et al. | 52/204.5 |
| 5,560,149 | A | * | 10/1996 | Lafevre | 49/501 |
| 5,934,031 | A | | 8/1999 | deNormand | |
| 6,293,049 | B1 | | 9/2001 | Shaw | |
| 6,341,449 | B1 | | 1/2002 | Stahl | |
| 6,530,190 | B2 | | 3/2003 | Conachen | |
| 6,662,512 | B2 | * | 12/2003 | Westphal | 52/204.5 |
| 6,722,089 | B2 | * | 4/2004 | Budzinski | 52/204.5 |
| 7,628,562 | B2 | * | 12/2009 | Annes | 403/329 |
| 2005/0028458 | A1 | | 2/2005 | Rosskamp et al. | |
| 2006/0185294 | A1 | * | 8/2006 | Langer et al. | 52/456 |
| 2007/0033880 | A1 | * | 2/2007 | Holevas | 49/449 |

* cited by examiner

*Primary Examiner* — Branon Painter
(74) *Attorney, Agent, or Firm* — Reising Ethington PC

(57) ABSTRACT

A window includes a window frame adapted to be secured to a building, a window sash, and a plurality of sash clips disposed around the sash and fixedly securing the sash to the frame. Each of the sash clips preferably includes a base secured in fixed position to the window frame and a head received in the window sash. The window frame and the sash preferably have peripheral rails of extruded aluminum, plastic or fiber-reinforced resin construction, and the base and head of the sash clips are received in corresponding channels on the window frame and the window sash. The base and/or the head of the sash of each sash clip may include opposed flexible resilient spring legs received in a channel in the corresponding rail. The sash clips may be of plastic construction.

26 Claims, 5 Drawing Sheets

SNAP CLIP RETAINER FOR WINDOW FIXED SASH

The present disclosure relates to a window assembly that includes a window frame and a fixed sash or panel secured to the window frame.

BACKGROUND AND SUMMARY OF THE DISCLOSURE

In window assemblies that include a window frame and a fixed sash or panel, the fixed sash conventionally is secured to the frame by glue or tape, or by threaded fasteners. A general object of the present disclosure is to provide a window in which the fixed sash is more readily and economically secured to the window frame.

The present disclosure embodies a number of aspects that can be implemented separately from or in combination with each other.

A window in accordance with one aspect of the present disclosure includes a window frame adapted to be secured to a building, a window sash, and a plurality of sash clips disposed around the sash and fixedly securing the sash to the frame. Each of the sash clips preferably includes a base secured in fixed position to the window frame and a head received in the window sash. The window frame and the sash preferably have peripheral rails of extruded aluminum, plastic or fiber-reinforced resin construction, and the base and head of the sash clips are received in corresponding channels on the window frame and the window sash. The base and/or the head of the sash of each sash clip may include opposed flexible resilient spring legs received in a channel in the corresponding rail. The sash clips may be of plastic construction.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
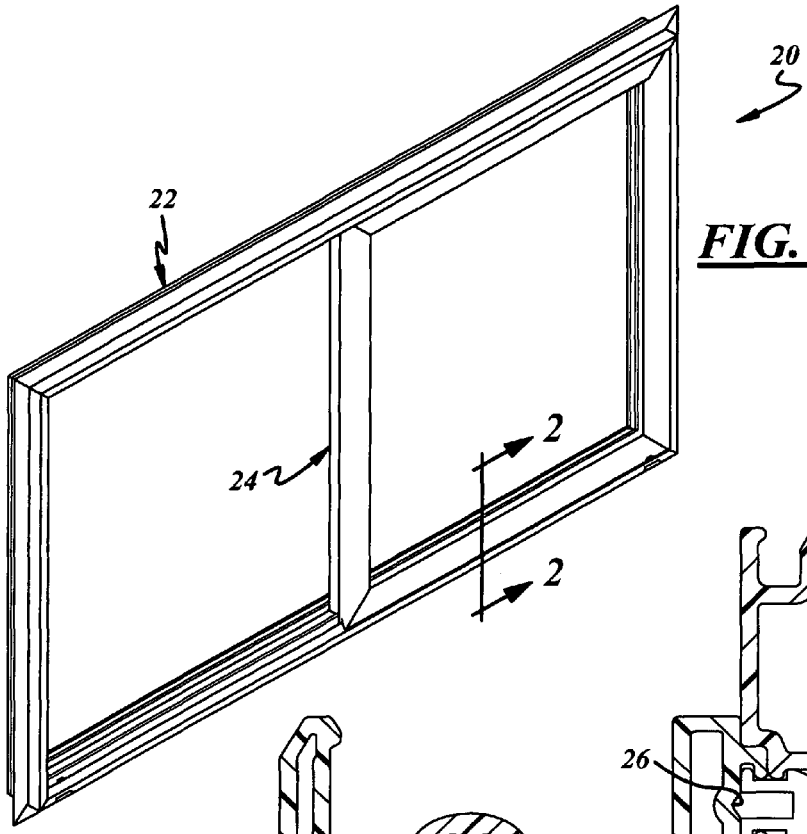
FIG. 1 is a perspective view of a window in accordance with one exemplary embodiment of the present disclosure with the movable sash or panel removed for clarity.

FIGS. 1-5 illustrate a window 20 in accordance with a first exemplary embodiment of the present disclosure. Window 20 includes a window frame 22 having top, bottom and side rails. A fixed sash 24 is secured to frame 22. Window 20 typically also would include a movable sash, which is not illustrated in FIGS. 1-5 for clarity. Fixed sash 24 has top, bottom and side rails in a generally rectangular geometry. The rails of window frame 22 and fixed sash 24 preferably are of extruded metal or plastic construction, such as aluminum construction or fiber-reinforced resin construction. Among other channels formed in the rails of frame 22 and sash 24 are a channel 26 in the rails of frame 22 and a channel 28 in the rails of fixed sash 24. At least one sash clip 30, and preferably a plurality of uniformly spaced sash clips 30, are received in channels 26, 28 fixedly to secure fixed sash 24 to window frame 22.

Figure 2:
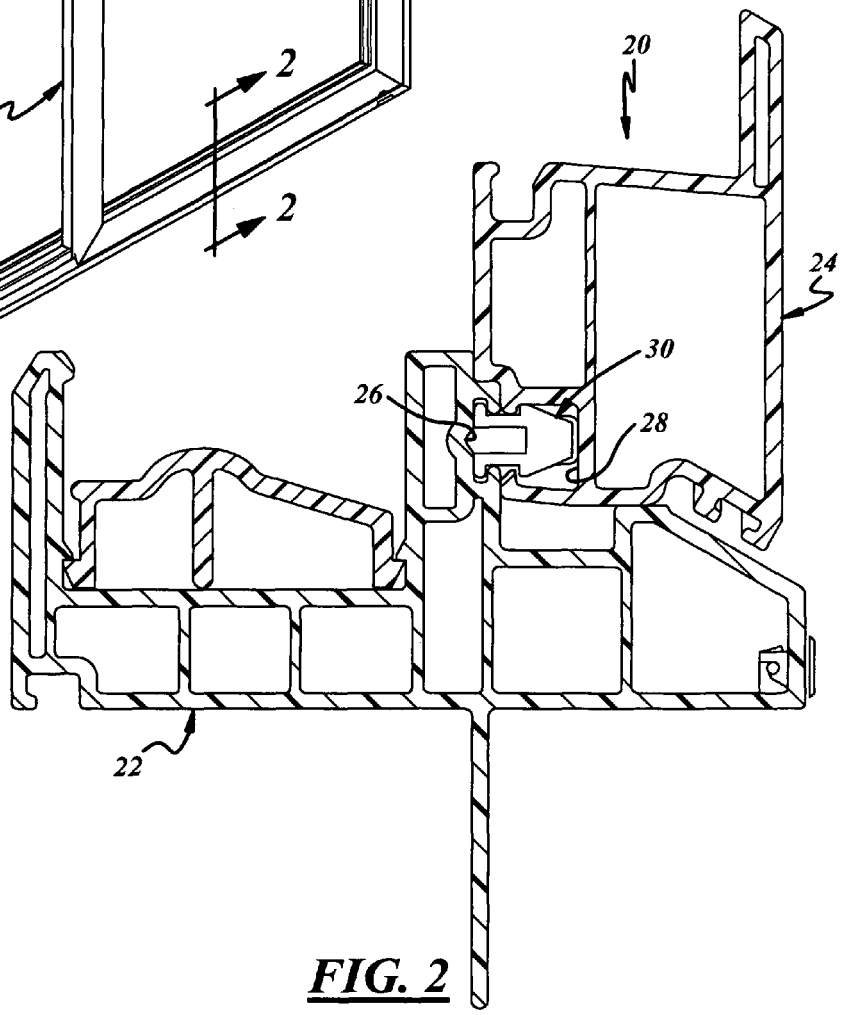
FIG. 2 is a sectional view taken substantially along the line 2-2 in FIG. 1.

Sash clip 30 includes a base 32 having opposed flexible resilient spring legs 34, 36. Spring legs 34, 36 have respective outwardly extending feet that are received in corresponding portions of channel 26 (FIGS. 2 and 4) to secure sash clip 30 to frame 22. A trapezoidal head 38 extends from base 32 and is received by press fit in channel 28 of fixed sash 24 (FIG. 2). In the embodiment of FIGS. 1-5, there preferably is a clip plunger 40 on head 38. Plunger 40 preferably is of compressible construction to engage and be compressed by the opposing wall of channel 28 in fixed sash 24, as shown in FIG. 2, to retard rattling of fixed sash 24 on window frame 22. Sash clips 30 preferably are disposed at uniform spacing around fixed sash 24, such as every foot. Sash clips 30 preferably are installed in the rails of window frame 22 before the rails are welded to each other to form the rectangular window frame. The trapezoidal construction of head 38 allows fixed sash 24 to be forced over the heads of the sash clips fixedly to secure fixed sash 24 to window frame 22.

Figure 3:
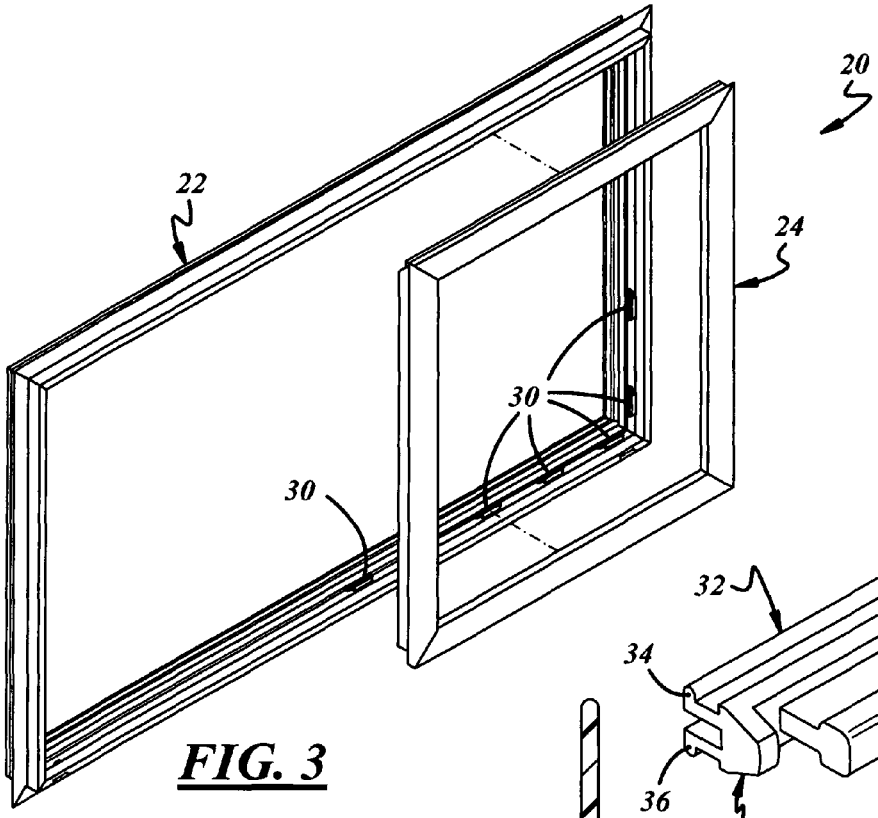
FIG. 3 is an exploded perspective view of the window illustrated in FIGS. 1 and 2.
Figure 5:
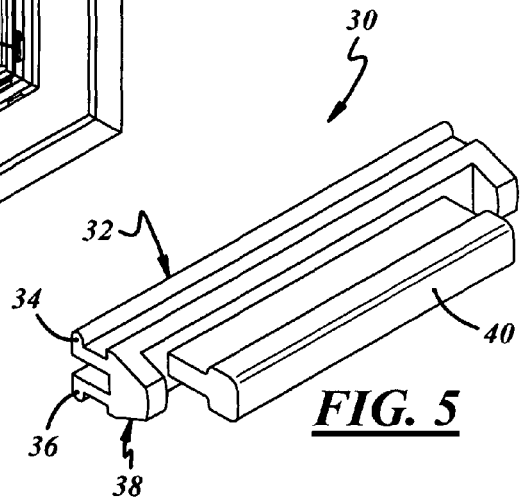
FIG. 5 is a perspective view of the sash clip employed in the window of FIGS. 1-4.
Figure 4:
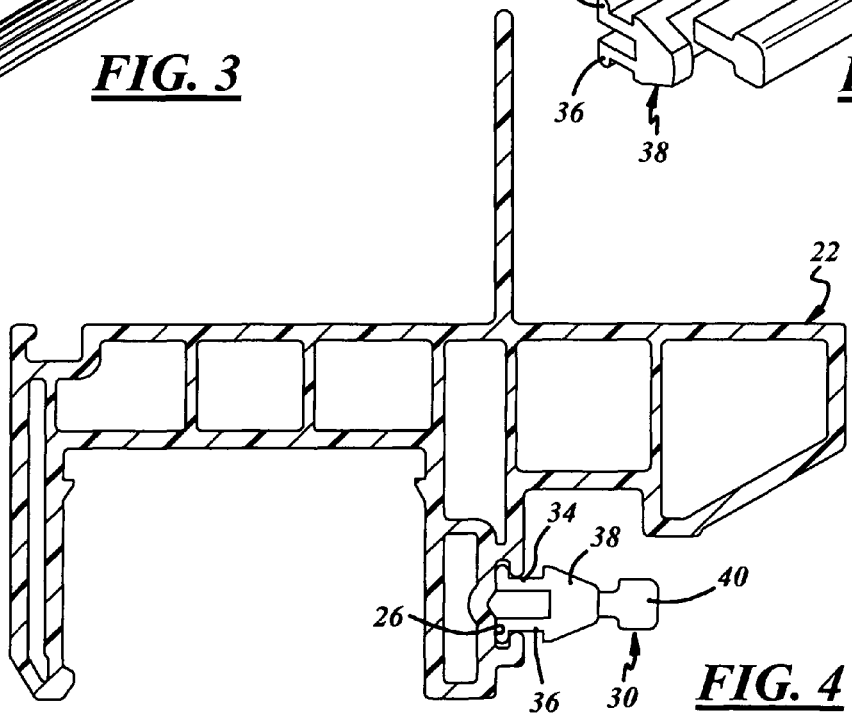
FIG. 4 is a sectional view of the window frame in FIGS. 1-3 with sash clip installed.
Figure 6:
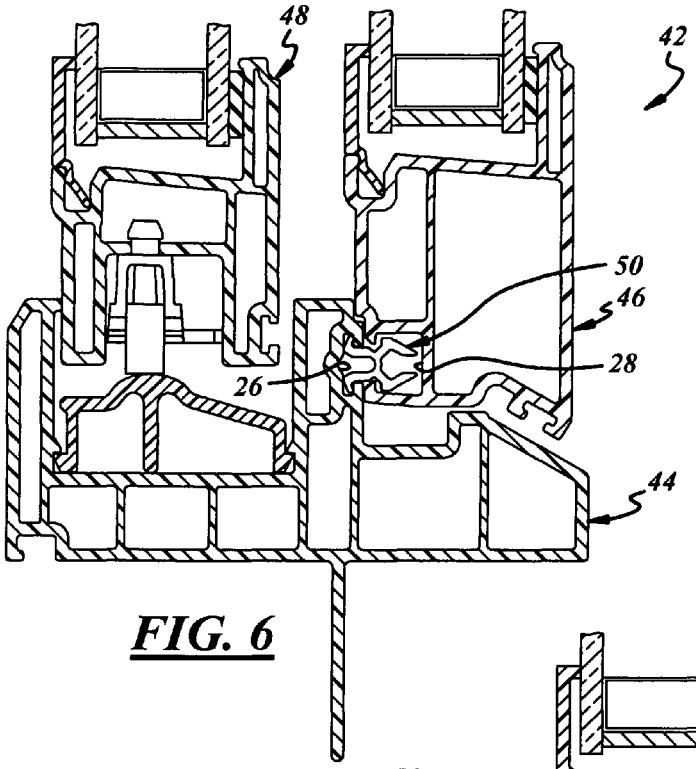
FIG. 6 is a sectional view of a window in accordance with a second exemplary embodiment of the present disclosure.
Figure 7:
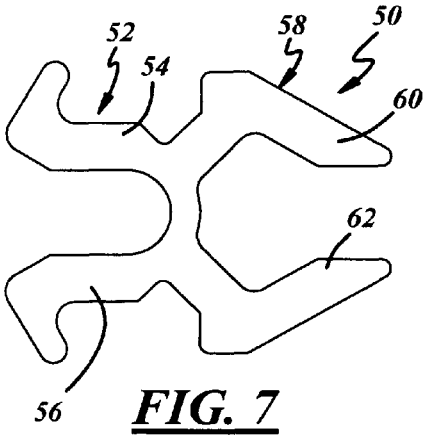
FIG. 7 is an elevational view of the sash clip in the window of FIG. 6.
Figure 8:
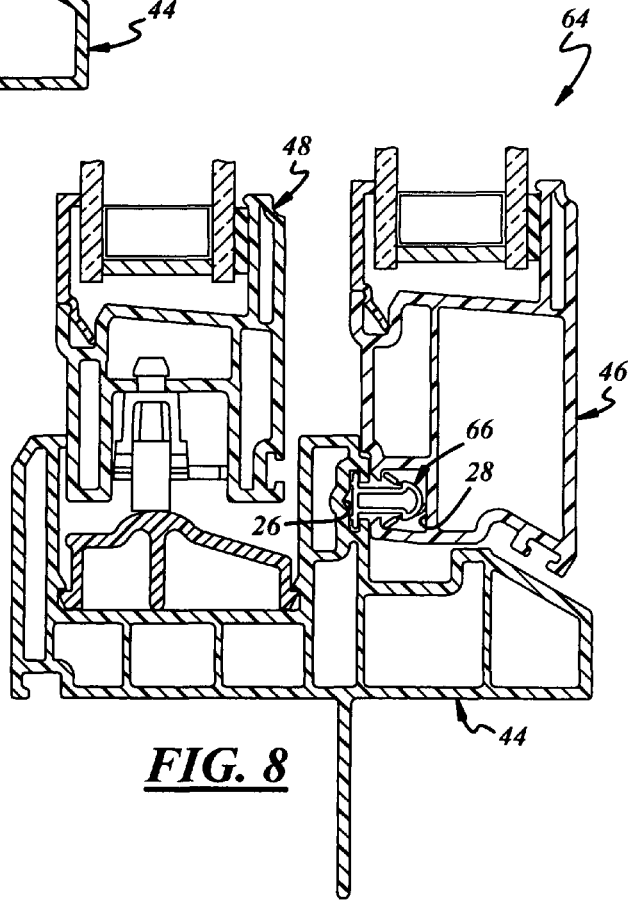
FIG. 8 is a sectional view of a window in accordance with a third exemplary embodiment of the present disclosure.
Figure 9:
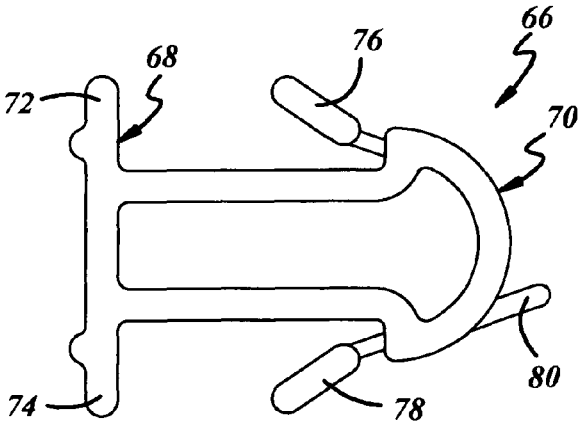
FIG. 9 is an elevational view of the sash clip in the embodiment of FIG. 8.
Figure 11:
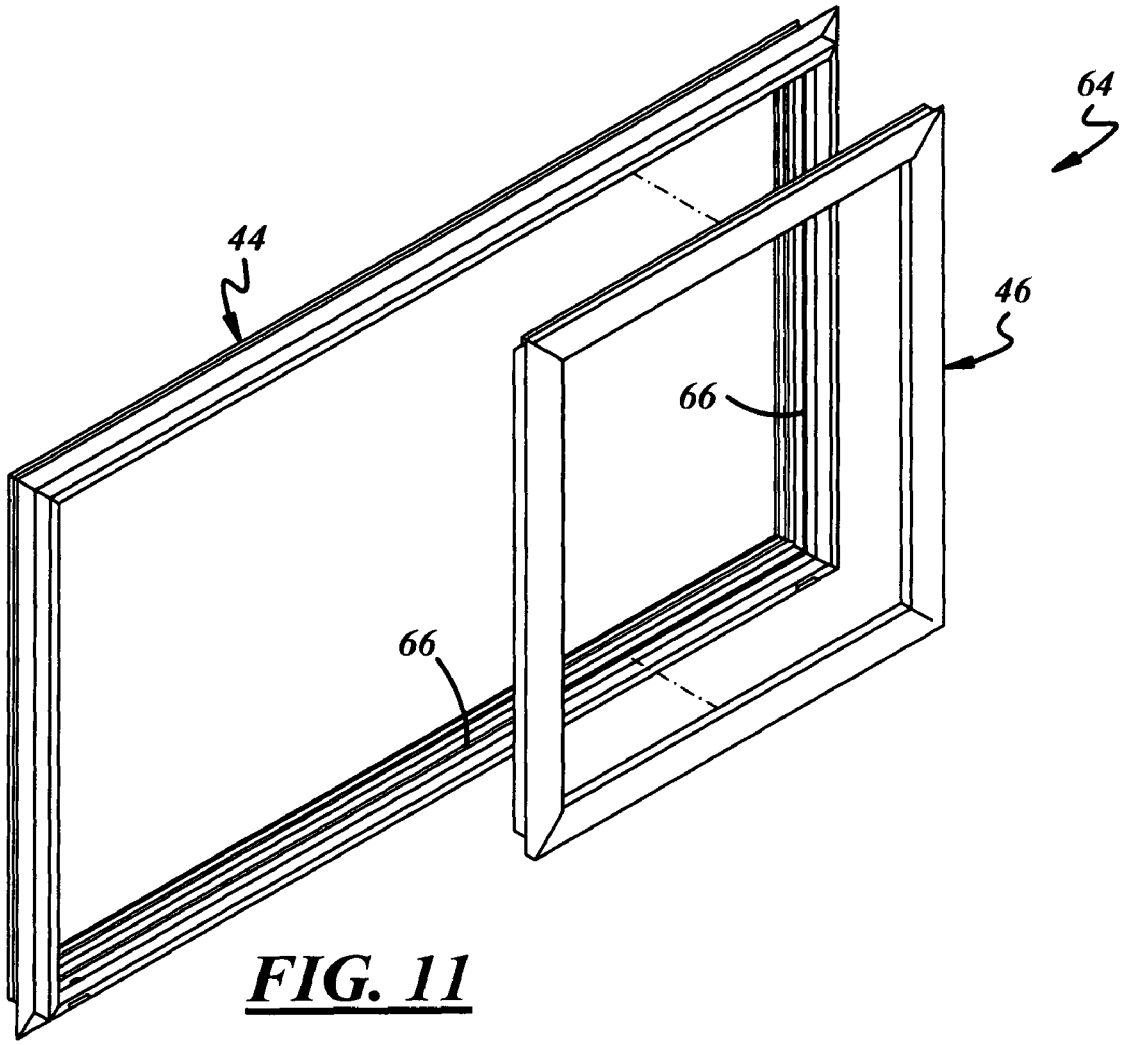
FIG. 11 is an exploded perspective view of the window illustrated in FIG. 8.

FIGS. 6 and 7 illustrate a window 42 having a window frame 44, a fixed sash 46 and a moveable sash 48. Sash clips 50 mount fixed sash 40 to window frame 44. Sash clips 50 have a base 52 with opposed legs 54, 56 and respective feet for securement within channel 26 of frame 44. Head 58 of clip 40 includes a pair of opposed legs 60, 62, the outsides of which form a generally trapezoidal geometry. Again, base 52 of spring clip 50 preferably is slid into channel 26 of frame 44 before the frame rails are welded to each other. Legs 60, 62 of head 58 are resiliently compressed toward each other as fixed sash 46 is assembled to frame 44 by forcing the heads 58 of the several sash clips into channel 28 of sash 46. Clips 50 can be short individual clips as illustrated in FIG. 3, or an extruded lineal clip that extends along all three sides of the fixed sash FIGS. 8, 9 and 11 illustrate a window 64 in accordance with a further exemplary embodiment of the present disclosure, including frame 44, fixed sash 46 and movable sash 48 as in the embodiment of FIG. 6. Sash clips 66 secure sash 46 to frame 44. Each sash clip 66 includes a base 68 and a head 70. Base 68 is generally T-shaped having opposed outwardly extending feet 72, 74 slidably received in channel 26 of frame 44, again preferably before welding the frame rails to each other. Head 70 has a rounded external contour and outwardly extending spring arms 76, 78 for engaging opposed edges of channel 28 and retaining spring clip head 70 in the channel. A third spring arm 80 extends longitudinally from head 70 for engaging the opposed base of channel 28 to prevent rattling of fixed sash 46 with respect to frame 44. Clip 60 preferably is an extruded lineal clip that extends along all three sides of the fixed sash (FIG. 11).

Sash clips 30, 50 and 66 preferably are of molded plastic construction.

Figure 10:
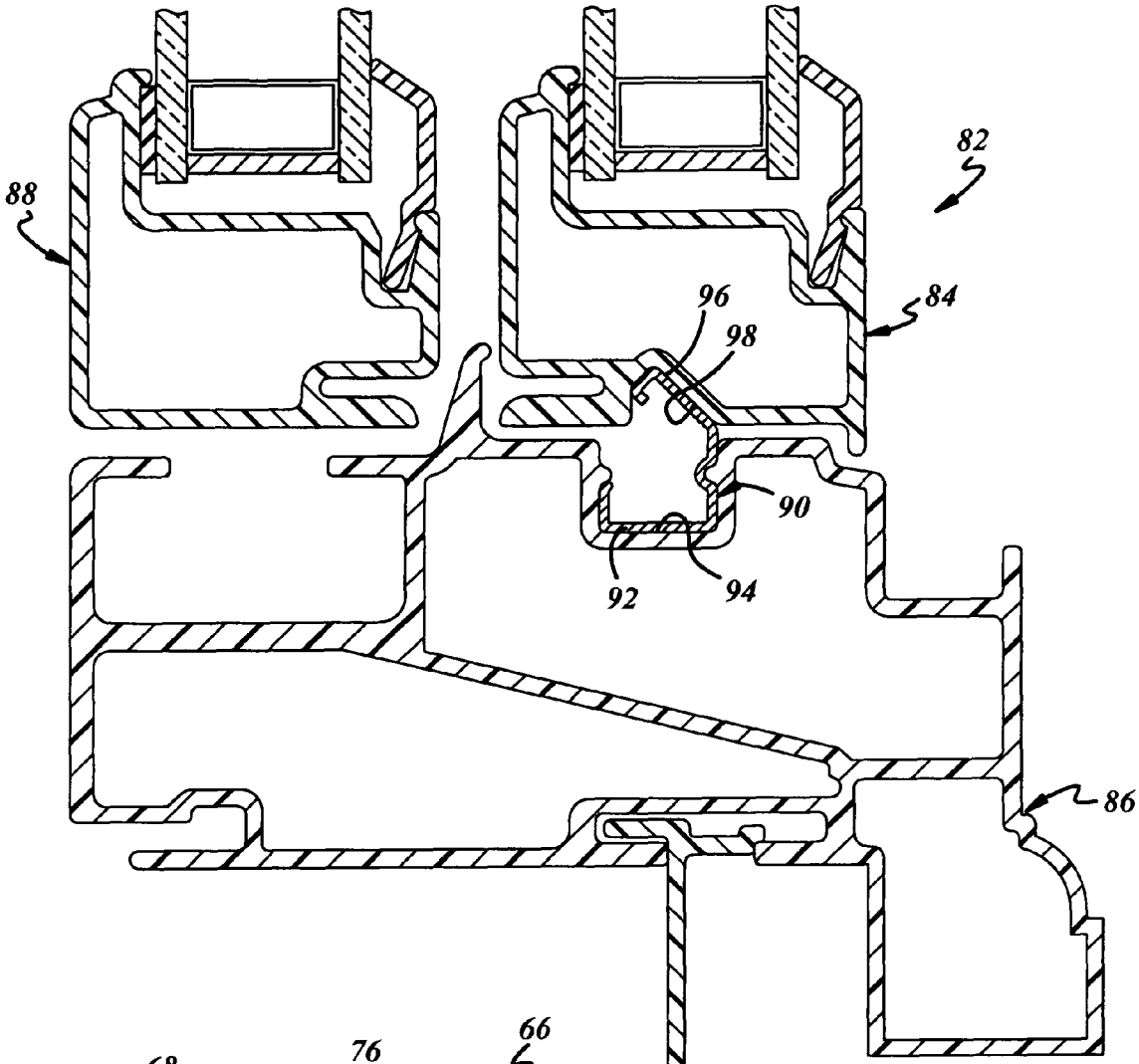
FIG. 10 is a sectional view of a window in accordance with a fourth exemplary embodiment of the present disclosure.

FIG. 10 illustrates a window 82 including a fixed sash 84 secured to a window frame 86 that also mounts a movable sash 88. Fixed sash 84 is mounted to frame 86 by uniformly spaced sash clips 90. Sash clips 90 in this embodiment can be of spring metal construction, including a base 92 received in a channel 94 in fixed frame 86, and a head 96 received in a channel 98 of fixed sash 84. Sash clip 90 is of generally C-shaped construction, and resiliency of leg 96 with respect to leg 92 suspends fixed sash 84 within window frame 86 and prevents rattling. Head 96 of sash clip 90 is angled toward movable sash 88 to prevent fixed sash 84 from being pulled out of frame 86.

There thus has been disclosed a window having a window frame with a fixed sash mounted by a plurality of sash clips, which fully satisfies all of the objects and aims previously set forth. The disclosure has been presented in conjunction with several exemplary embodiments, and additional modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A window that includes:

a window frame adapted to be secured to a building, a fixed window sash, and at least one sash clip mounted to said window frame and fixedly securing said fixed window sash to said window frame, such that said fixed window sash is not moveable with respect to said window frame, wherein said at least one sash clip includes a base secured in fixed position to said window frame and a head received in said fixed window sash, wherein said window frame and said fixed window sash have rails with longitudinal channels in said rails, and wherein said head is received in one of said longitudinal channels of one of said rails of said fixed window sash and said base has opposed flexible resilient spring legs with respective outwardly extending opposed feet received in corresponding portions of one of said longitudinal channels of one of said rails of said window frame.

2. The window set forth in claim 1 wherein said at least one sash clip includes plural sash clips disposed at uniform spacing around said window frame and said fixed window sash.

3. The window set forth in claim 1 wherein said at least one sash clip is elongated and extends along three sides of said sash.

4. The window set forth in claim 1 wherein said spring legs are slidably received in one of said longitudinal channels of one of said rails of said window frame.

5. The window set forth in claim 4 including a compressible plunger projecting from said head in a direction opposite that of said base for engaging said fixed window sash to retard rattling of said fixed window sash with respect to said window frame.

6. The window set forth in claim 1 wherein said head also has opposed flexible resilient spring legs received in said fixed window sash.

7. The window set forth in claim 6 wherein said fixed window sash has a longitudinal channel and said head spring legs are slidably received in said longitudinal channel.

8. The window set forth in claim 1 wherein said at least one sash clip is of plastic construction.

9. The window set forth in claim 1 wherein said peripheral rails of said window frame and said fixed window sash are of extruded metal, plastic or fiber-reinforced resin construction.

10. The window set forth in claim 1 wherein said sash clip base is T-shaped having outwardly extending feet received in one of said longitudinal channels of said window frame, and said sash clip head is rounded having outwardly extending spring arms for engaging one of said longitudinal channels of said sash and retaining said sash clip head therein, and having another spring arm extending from said head for engaging an opposed base of one of said longitudinal channels of said sash to prevent rattling of said fixed window sash with respect to said window frame.

11. The window set forth in claim 1 wherein said sash clip is C-shaped and suspends said fixed window sash within said window frame to prevent rattling.

12. The window set forth in claim 11, wherein said at least one sash clip is of spring metal construction.

13. The window set forth in claim 11, further comprising a movable sash mounted in said window frame, and wherein said sash clip head is angled toward said movable sash to prevent said fixed window sash from being pulled out of said window frame.

14. The window set forth in claim 1 wherein said window frame rails include at least two adjacent rails, and wherein said at least one sash clip includes plural sash clips mounted to said adjacent rails.

15. The window set forth in claim 1 wherein said window frame rails include a top rail, a bottom rail, and two side rails, and wherein said at least one sash clip includes plural sash clips mounted to one of said two side rails and at least one of said top or bottom rails.

16. The window set forth in claim 1 wherein said feet are slidably received in one of said longitudinal channels of one of said rails of said window frame.

17. The window set forth in claim 1 wherein said head is trapezoidal.

18. The window set forth in claim 17, wherein said trapezoidal head is received by press fit in one of said longitudinal channels of one of said rails of said fixed window sash.

19. The window set forth in claim 1 wherein said head has opposed legs received in one of said longitudinal channels of one of said rails of said fixed window sash.

20. The window set forth in claim 1 wherein said head has outwardly extending spring arms for engaging opposed edges of one of said longitudinal channels of one of said rails of said fixed window sash and retaining said head in one of said longitudinal channels of one of said rails of said fixed window sash.

21. The window set forth in claim 20 wherein said at least one sash clip also has an additional spring arm extending from said head for engaging an opposed base of one of said longitudinal channels of one of said rails of said fixed window sash to prevent rattling of said fixed window sash with respect to said window frame.

22. The window set forth in claim 1 wherein said head has rounded external contours.

23. A window that includes:

a window frame adapted to be secured to a building, a fixed window sash, and at least one sash clip mounted on said window frame and fixedly securing said fixed window sash to said window frame, such that said fixed window sash is not moveable with respect to said window frame, wherein said at least one sash clip includes a base secured in fixed position to said window frame and a trapezoidal head received in said fixed window sash, wherein a compressible plunger projects from said head in a direction opposite of said base for engaging said fixed window sash to retard rattling of said fixed window sash with respect to said window frame.

24. A window that includes:

a window frame including a top rail, a bottom rail, and two side frame rails, a fixed window sash having a top rail, a bottom rail, and two side sash rails, and at least one sash clip fixedly securing said fixed window sash to said window frame, wherein said at least one sash clip includes plural sash clips mounted to at least one of said two side frame rails and at least one of said top or bottom frame rails, wherein said window frame and said fixed window sash have rails, wherein said rails of said window frame and said fixed window sash have longitudinal channels therein, wherein said at least one sash clip includes a head received in one of said longitudinal channels of one of said rails of said fixed window sash and a base secured in fixed position to said window frame and having flexible resilient spring legs with respective outwardly extending opposed feet received in corresponding portions of one of said longitudinal channels of said window frame.

25. The window set forth in claim 24 wherein said at least one sash clip includes plural sash clips correspondingly mounted to one of said two side sash rails and at least one of said top or bottom sash rails.

26. The window set forth in claim 25 wherein said at least one sash clip includes plural sash clips mounted to said top and bottom rails of said window frame and are correspondingly mounted to said top and bottom rails of said fixed window sash.

* * * * *